US005450700A

United States Patent [19]

Hackman

[11] Patent Number: 5,450,700

[45] Date of Patent: Sep. 19, 1995

[54] METHOD FOR REINFORCING A FOUNDATION

[75] Inventor: Lloyd E. Hackman, Worthington, Ohio

[73] Assignee: Ribbon Technology Corporation, Gahanna, Ohio

[21] Appl. No.: 96,519

[22] Filed: Jul. 23, 1993

[51] Int. Cl.[6] ..... E04G 23/00; E04C 5/00; E04B 2/20

[52] U.S. Cl. ..... 52/425; 52/431; 52/438; 52/439; 52/293.2; 52/294; 52/565; 264/35

[58] Field of Search ..... 264/35; 52/743, 747, 52/421, 425, 415, 431, 437–439, 562, 565, 745.09, 293.2, 294, 436

[56] References Cited

U.S. PATENT DOCUMENTS

| | | | |
|---|---|---|---|
| 1,646,113 | 10/1927 | Lanza | 52/425 |
| 1,704,255 | 3/1929 | Lewis | 52/293.2 |
| 4,315,391 | 2/1982 | Piazza | 52/743 X |
| 4,353,194 | 10/1982 | Norton | 52/743 X |
| 4,452,028 | 6/1984 | Norton et al. | 52/744 |
| 4,563,852 | 1/1986 | Achtenberg et al. | 52/743 |
| 5,065,560 | 11/1991 | Yoder | 52/421 X |

*Primary Examiner*—Carl Friedman
*Assistant Examiner*—Robert Canfield
*Attorney, Agent, or Firm*—Thompson, Hine and Flory

[57] ABSTRACT

Described herein is a method for reinforcing a cement block structure having a plurality of vertical cavities therein comprising:

providing an access to at least one vertical cavity in the cement block structure large enough to insert a fiber reinforcing element;

inserting a fiber reinforcing element through the access such that the element fills the cavity;

introducing a slurry of cementitious material into the cavity through the access so that the slurry of cementitious material fills the cavity and infiltrates and encapsulates the fiber reinforcing element; and curing the cementitious material.

20 Claims, 2 Drawing Sheets

METHOD FOR REINFORCING A FOUNDATION

FIELD OF THE INVENTION

The present invention relates to a method for the reinforcement of cement block foundation with a fiber reinforcing element and a cementitious composition.

BACKGROUND OF THE INVENTION

Many building foundations and retaining walls are constructed with cement block. The cement blocks are generally stacked on top of one another with their hollow center cavities aligned axially. The arrangement of cement blocks forms vertical cavities within the foundation or wall that are void of any solid material. Earthquakes and other movements of the ground generate shear and compression forces in the ground that act upon a foundation or wall. Cement block foundations and walls have been found to be especially susceptible to damage from earthquakes due to these forces.

Currently, there are several techniques used to reinforce cement block structures such as walls and foundations. One technique uses a plurality of metal girders. One end of the girder is positioned against the upper portion of the cement block structure and the other end is positioned against the ground at an angle to the wall. Use of these girders is unsatisfactory because they take up space and limit the usefulness of the area where they are positioned.

Instead of reinforcing an existing foundation, another technique is to replace the foundation. Jacks are used to lift the building off the foundation and hold it in position above the foundation while the foundation is removed and replaced by a new more sturdy foundation. The building is lowered and anchored to its new foundation. This technique is expensive, time consuming, and poses a risk of damage to the building while the foundation is replaced.

Accordingly, an improved means for reinforcing cement block structures such as foundations is desired.

SUMMARY OF THE INVENTION

In accordance with the present invention, a method is provided for the reinforcement of a cement block structure with a fiber reinforcing element and a slurry of a cementitious composition. This technique can be used to reinforce an original concrete block structure or to repair or retro-reinforce an existing one.

While the discussion herein will refer to metal fibers, those skilled in the art will appreciate that the other fibers mentioned herein can also be used.

In one embodiment of the present invention, a hole or other access is opened in a cement block foundation to provide access to a vertical cavity in the foundation. The hole is large enough to enable the metal fiber reinforcing elements and a slurry of cementitious composition to be inserted into the cavity in the foundation. Sufficient metal fiber reinforcing element is inserted so that the cavity is filled. Next, a slurry of cementitious composition is introduced through the hole into the cavity in an amount sufficient to fill the cavity and infiltrate and encapsulate the fiber. After the cavity is filled with the cementitious composition, the hole is closed and the composition is allowed to cure.

In a second embodiment of the invention, a metal fiber mat is retofitted to reinforce the inside face of the wall. First, the mat is attached to the wall using a conventional fastening means. Next a temporary form is used over the outside of the mat. Then a slurry of cementitious composition is added in an amount sufficient to fill the cavity between the wall and the form and to infiltrate and incapsulate the metal fiber mat. After the cement has cured, the form is removed.

There are several advantages to the present invention. It does not impede use of the building or reduce useable space. It does not require that the building be moved and the process is relatively inexpensive in comparison to alternative reinforcing methods and yet provides a structure with significantly enhanced earthquake resistance.

BRIEF DESCRIPTION OF THE DRAWINGS

FIG. 1 is a perspective view of a non-woven fiber mat rolled upon itself for use in the method of the invention.

DEFINITIONS

Figure 1:
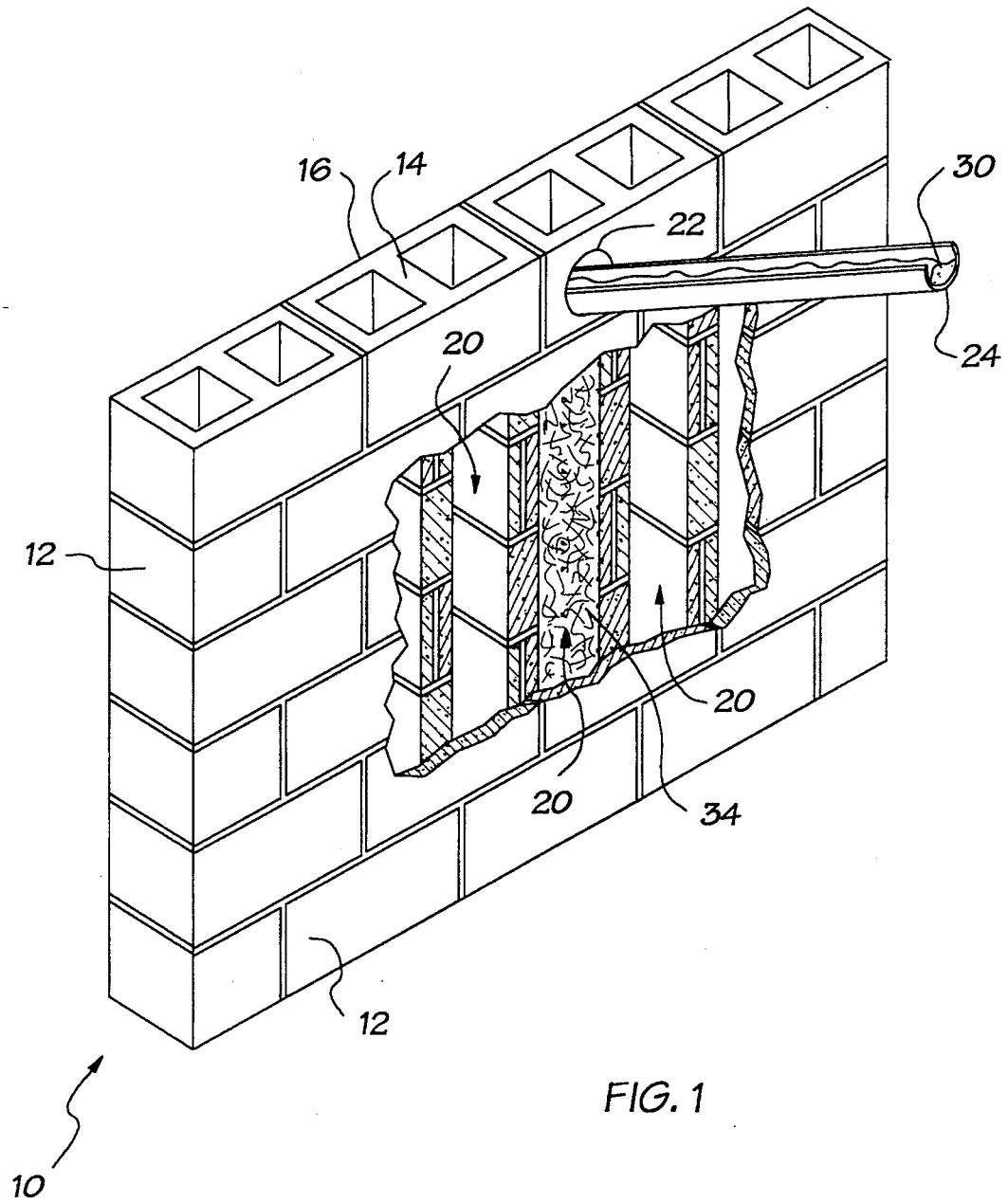
FIG. 1 is a sectional view of a cement block foundation having fiber mats and a cement composition in one of the walls' cavity.

The term "non-woven" as used herein with respect to the metal fiber mats means that the fibers forming the mat are not systematically woven. The mat is held together by random entanglement of the fibers. Typically, the fibers are air-laid.

The term "effective diameter" is used herein as it is used in the art, namely, to mean the diameter of a circle the area of which is equal to the cross-sectional area of the fiber element.

DETAILED DESCRIPTION OF THE INVENTION

The fibers used in the reinforcing method can be metal fibers, glass fibers, carbon fibers, synthetic polymer fibers such as polyolefins, polyamides, polyimides, etc. Preferably, the fibers are metal fibers. The metal fibers used in the present invention are preferably cast metal fibers such as stainless steel, carbon steel, or manganese steel. Fibers may be up to 12 inches in length and make up about 1 to 10% by volume of the reinforcement.

The fibers may be placed into the cavity as individual fibers or in the form of a rolled or tubular nonwoven mat. Metal fibers can be prepared by methods and apparatus described in U.S. Pat. Nos. 4,813,472 and 4,930,565 assigned to Ribbon Technology Corporation (Ribtec) of Gahanna, Ohio. These patents disclose the production of metal filamentary materials ranging from a size less than 1 inch up to a semi-continuous fibers. Mats are commercially available from Ribtec under the tradename MmatTEC. In mats, the fibers are about 4 to 12 inches long and more preferably about 9 inches long. The fibers have an effective diameter of about 0.002 to 0.060 inch and, preferably, about 0.01 and 0.025 inch. The aspect ratio (length/diameter ratio) is typically greater than 300, and preferably 400 to 800. In the case of essentially continuous fiber, the aspect ratio is unlimited.

To prepare the mats, fibers prepared in accordance with the teachings in the aforementioned patents are forcibly directed into a chute where they are air-laid onto a conveyor and compressed into a mat. By controlling the speed of the conveyor and the extent of compression of the mat, the density of the mat can be controlled to produce mats in the range of 1.5 to 10% density by volume. In order to incorporate more than about 10% fiber into a reinforcement, the mat must be compressed to an extent that it cannot readily be infiltrated with a cementitious mixture. Typically, the reinforcement in accordance with the invention is prepared from mats which contain about 2 to 6% by volume fiber.

Individual metal fibers can also be used in the present invention. They are commercially available from Ribtec under the tradename SIFCON. In general, these metal fibers may range in length from about ¾ to 2.0 inch, have a diameter of from 10 to 3 mils and possess an aspect ratio (length/diameter) greater than 50. Fibers outside this range can be used if care is taken to prevent local fiber-deficient pockets from occurring when placing the fibers in the cavity.

The fibers may be randomly oriented or oriented to maximize the strength of the reinforcement in a selected direction. For example, the fibers may be oriented parallel to the direction in which the foundation encounters its principal stressors. Regardless of their orientation, the fibers are not woven in a systematic manner.

The cementitious compositions used in the present invention include hydraulic and polymer cements. Mortar and concrete compositions are also useful. Representative examples of useful cements include Portland Cement, Calcium Aluminate Cement, Magnesium Phosphate Cement, and other inorganic cements. The cementitious compositions must have a consistency which will allow them to easily penetrate and encapsulate the metal fibers. Preferably, they are a free-flowing liquid. Useful aggregates may range up to about 30 mesh (0.023 inch) so they are not strained from the composition as they impregnate the mat. Examples of aggregates include sand and small gravel. The compositions preferably have a ratio by weight of water to cement in the range of about 0.35 to 0.5, and, preferably, about 0.37 to 0.40.

A superplasticizing agent may be added to the cementitious composition to better enable it to infiltrate the fibers and fill a cavity. The superplasticizing agent is not required but is preferred. Without the superplasticizing agent, more water must be added to the cementitious composition to infiltrate the fibers. Superplasticizing agents are known and have been used in flowing concrete and water-reducing, high-strength concrete. See for example, "Superplasticized Concrete", ACI Journal, May, 1988, pp. N6–N11 and "Flowing Concrete, Concrete Costr., Jan 1979", pp. 25–27. The most common superplasticizing agents are sulfonated melamine formaldehyde and sulfonated naphthalene formaldehyde. Superplasticizing agents used in the present invention are those which enable the aqueous cementitious composition to fully infiltrate the packed fibers. Of the superplasticizing agents that are commercially available, Mighty 150, a sulfonated naphthalene formaldehyde available from ICI, is preferred.

Figure 2:
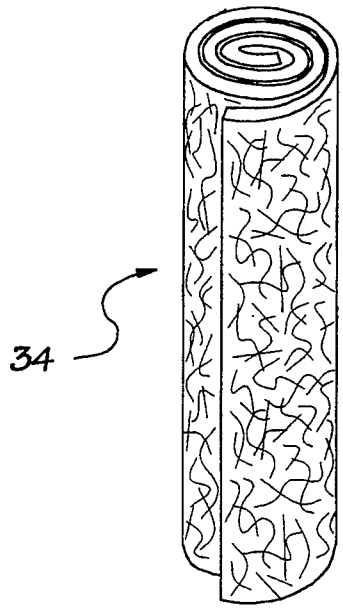

A new and improved method for reinforcing a cement block structure with fiber reinforcing elements and a slurry of cementitious composition is illustrated in FIGS. 1–2. FIG. 1 is a sectional view of a cement block foundation reinforced in accordance with the present invention. As illustrated in FIG. 1, the cement block foundation 10 comprises a plurality of cement blocks 12, also known as cinder blocks, arranged whereby mortar secures the blocks 12 together in an wall-like fashion. A cement block 12 comprises two panels 16 parallel to each other and connected by three beams 14 positioned parallel to each other and perpendicular to the panels 16. Within the foundation, a plurality of cavities 20 are formed by the arrangement of cement blocks 12. The cavities 20 are bordered by the panels 16 and the column beams 14.

In accordance with the present invention, a hole or other access 22 is opened in the panel 16 immediately outside a cavity 20 in the upper portion of the wall or foundation. Preferably, the hole 22 is located at the top of the foundation 10. The hole 22 must be large enough and positioned so that a fiber reinforcing element 34 and a slurry of cementitious composition 30 can be inserted through the hole 22 and into the cavity 20 such that they fill the cavity 20.

Typically, a non-woven mat of reinforcing metal fiber 34 is rolled up upon itself to form a cylinder. See FIG. 2. After being rolled into a cylinder, the fiber reinforcing element 34 is fed into the cavity through the hole 22.

When the fiber is fed into the cavity 20, particularly when it is fed in the form of individual fibers, it may be desirable to subject the cement block structure to vibration, ultrasonic stimulation or the like to ensure that the fiber reinforcing elements settle uniformly in the cavity. Care must be taken so that the fiber packs uniformly in the cavity 20 and does not become locally packed into one area of the cavity 20 leaving other areas of the cavity 20 void of fiber.

After the fiber is in place, a cementitious composition 30 is introduced to the cavity 20 through the hole 22 using any suitable cement conveying means 24. Although a chute 24 is used to illustrate the present invention, those skilled in the art will appreciate that the cementitious composition can be conveyed into the cavity using other known methods. It may be desired that the cementitious composition be pumped into the cavity under pressure. Pressure in the range of about 0.1 to 14 psi may be useful.

The cementitious composition 30 spreads through the interstitial voids of the fiber in a downward movement until all such voids are infiltrated to the bottom of the cavity 20. Addition of the composition ceases when the cavity 20 is filled, or a predetermined level is reached. Care must be taken to allow air to escape from the cavity 20 as the cavity 20 fills with the cementitious composition 30 to reduce air pockets from forming therein.

Figure 3:
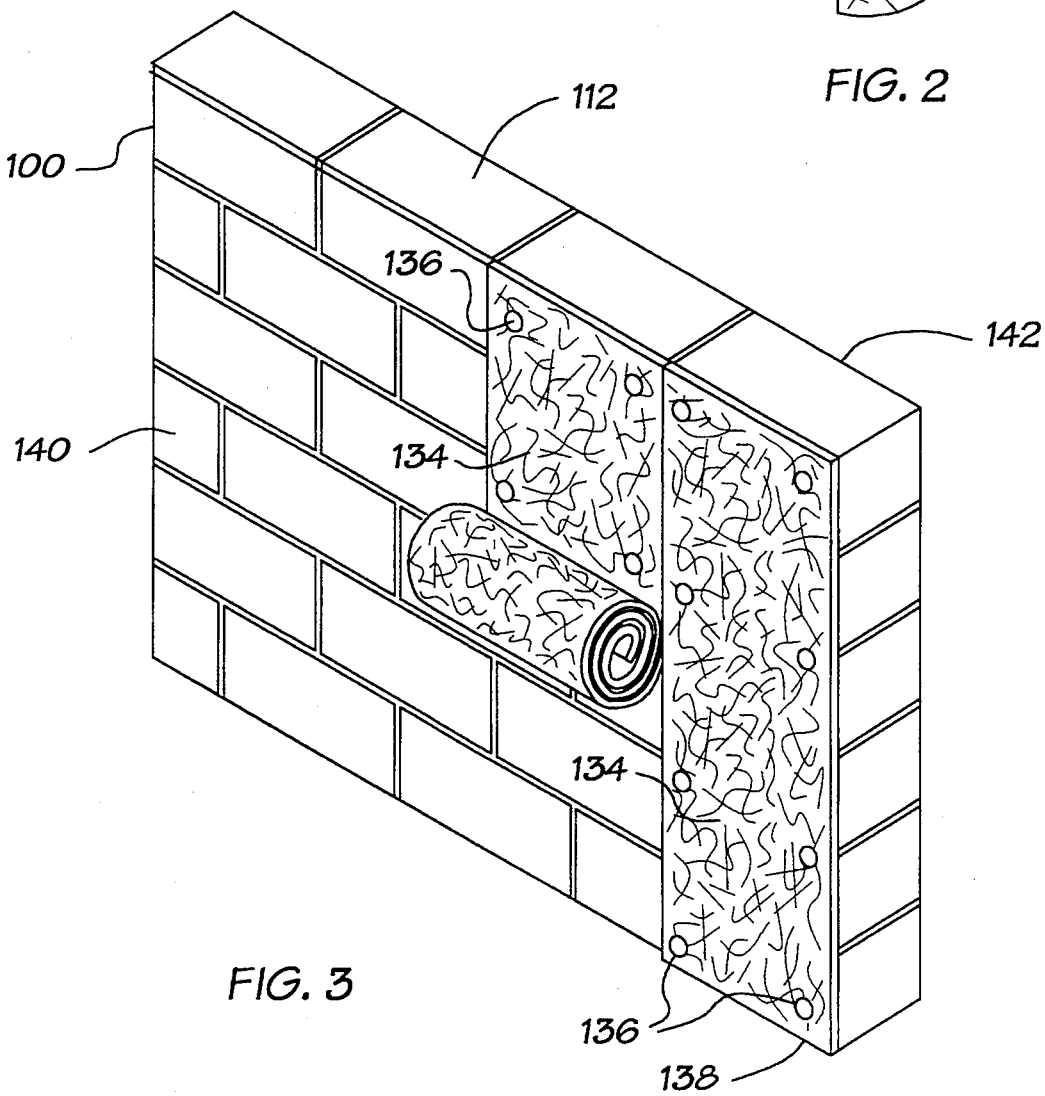
FIG. 3 is a perspective view of a cement block foundation having a non-woven metal fiber mat attached to its face for infiltration with cement in accordance with the invention.

FIG. 3 presents a second embodiment of the invention. In this second embodiment, a metal fiber mat can be used to reinforce a wall by retrofitting the metal fiber mat to the inside face of the wall. The inside face 140 of the wall is shown in FIG. 3. A non-woven metal fiber mat 134 is placed against the inside face 140 of the wall. The mat 134 is fastened to the wall 140 by a conventional fastening means 136 such as concrete nails, spikes or the like. An adhesive may also be used. Once fastened to the wall, a wooden or plastic form (not shown) is placed on the outside surface of the metal fiber mat creating a cavity between the form and the wall containing the mat.

Once the form is in place over the outside surface of the metal fiber mat, a cementitious composition is introduced between the form and the wall. The cementitious composition spreads through the interstitial voids of the fiber mat in a downward movement until all such voids are infiltrated to the bottom 138 of the mat 134 138.

Addition of the composition ceases when the area between the form and the wall is filled with the cementitious composition. Again, care must be taken to allow air to escape from the area between the face 140 and the form (not shown) as the area fills with the cementitious composition to reduce air pockets from forming. Once the cement has cured, the form is removed.

Although this invention has been described as a retrofitting, one skilled in the art will also appreciate the advantages of using this invention at the time of construction of the wall.

Having described the invention in detail and by reference to a preferred embodiment thereof, it will be apparent that modification sand variations may be made without departing from the scope of the invention.

What is claimed is:

1. A method for reinforcing cement block structure having a plurality of vertical cavities therein comprising:

providing an access to at least one vertical cavity in said cement block structure large enough to insert fiber reinforcing element;

inserting fiber reinforcing element through said access such that said element fills said cavity;

introducing a slurry of cementitious material into said cavity through said access, said slurry of cementitious material filling said cavity and infiltrating and encapsulating said fiber reinforcing element; and curing said cementitious material.

2. The method of claim 1 wherein said fiber reinforcing element is a non-woven mat of metal fibers.

3. The method of claim 2 wherein said non-woven mat is rolled upon itself to form a cylinder.

4. The method of claim 3 wherein said metal fibers are present in said cavity in an amount of about 2 to 10% by volume.

5. The method of claim 1 wherein said cementitious material contains aggregate having a particle size of less than about 30 mesh.

6. The method of claim 1 wherein said cementitious material is a hydraulic cement or a polymer cement.

7. The method of claim 1 wherein said cementitious material contains a superplasticizing agent selected from the group consisting of sulfonated melamine formaldehyde and sulfonated naphthalene formaldehyde to facilitate permeation of said cementitious material throughout said non-woven mat.

8. The method of claim 7 wherein said superplasticizing agent is sulfonated naphthalene formaldehyde.

9. The method of claim 1 wherein said cement block structure is a wall.

10. The method of claim 1 wherein said cement block structure is a building foundation.

11. The method of claim 2 wherein said metal fibers are selected from the group consisting of cast stainless steel, carbon steel and manganese steel.

12. A reinforced cement block structure comprising a plurality of cement blocks having at least one vertically oriented channel therein, said blocks being stacked upon one another such that their channels align axially to form at least one vertical cavity in said structure, said at least one vertical cavity containing a fiber reinforced cementitious composite, said fiber reinforced cementitious composite containing a non-woven mat of fibers and a cementitious material, wherein said non-woven mat of fibers is rolled upon itself to form a cylinder.

13. The structure of claim 11 wherein said fibers are metal fibers.

14. The structure of claim 12 wherein said metal fibers are present in said cavity in an amount of about 2 to 10% by volume.

15. The structure of claim 13 wherein said metal fibers are selected from the group consisting of cast stainless steel, carbon steel and manganese steel.

16. The structure of claim 12 wherein said cementitious material contains aggregate having a particle size of less than about 30 mesh.

17. The structure of claim 12 wherein said cementitious material is a hydraulic cement of a polymer cement.

18. The structure of claim 12 wherein said cement block structure is a wall.

19. The structure of claim 12 wherein said cementitious material contains a superplasticizing agent selected from the group consisting of sulfonated melamine formaldehyde and sulfonated naphthalene formaldehyde to facilitate permeation of said cementitious material throughout.

20. The structure of claim 19 wherein said superplasticizing agent is sulfonated napthalene formaldehyde.

* * * * *